US005555872A

United States Patent [19]

Takeuchi et al.

[11] Patent Number: 5,555,872

[45] Date of Patent: Sep. 17, 1996

[54] FUEL PUMP CONTROL DEVICE FOR INTERNAL COMBUSTION ENGINE

[75] Inventors: Shigeru Takeuchi, Gamagouri; Taketoshi Sato, Kariya; Takahiko Hasegawa, Nukata-gun, all of Japan

[73] Assignee: Nippondenso Co., Ltd., Kariya, Japan

[21] Appl. No.: 449,359

[22] Filed: May 24, 1995

[30] Foreign Application Priority Data

May 26, 1994 [JP] Japan ..... 6-112875

[51] Int. Cl.[6] ..... F02M 37/04

[52] U.S. Cl. ..... 123/497; 123/198 D

[58] Field of Search ..... 123/497, 357, 123/358, 359, 198 D, 379

[56] References Cited

U.S. PATENT DOCUMENTS

| | | | |
|---|---|---|---|
| 4,359,984 | 11/1982 | Nakao | 123/497 |
| 4,430,980 | 2/1984 | Pidgeon | 123/497 |
| 4,791,905 | 12/1988 | Furuta | 123/497 |
| 4,919,102 | 4/1990 | Iwabuchi | 123/497 |
| 5,092,302 | 3/1992 | Mohan | 123/497 |
| 5,293,299 | 3/1994 | Iwabuchi | 123/497 |
| 5,313,923 | 5/1994 | Takeuchi et al. . | |
| 5,379,741 | 1/1995 | Matysiewicz | 123/497 |

FOREIGN PATENT DOCUMENTS

| | | |
|---|---|---|
| 60-261969 | 12/1985 | Japan . |
| 61-43264 | 3/1986 | Japan . |
| 62-131965 | 6/1987 | Japan . |
| 4325764 | 11/1992 | Japan . |

*Primary Examiner*—Carl S. Miller

*Attorney, Agent, or Firm*—Cushman, Darby & Cushman

[57] ABSTRACT

In a pump control circuit, if a battery voltage declines to a voltage level lower than that required to insure a constant voltage, a low-voltage detection circuit outputs a low voltage detection signal. In the case of the decline in the battery voltage, an NOR circuit outputs the conversion signal from an internal logic section, and a pump control signal bypassing the internal logic section, giving priority to the latter signal. A motor drive circuit turns FET ON and OFF in accordance with the output signal of the NOR circuit. According to ON/OFF of the FET, the intermittent control of the current from the battery to the pump drive motor is performed.

12 Claims, 5 Drawing Sheets

FIG. 2
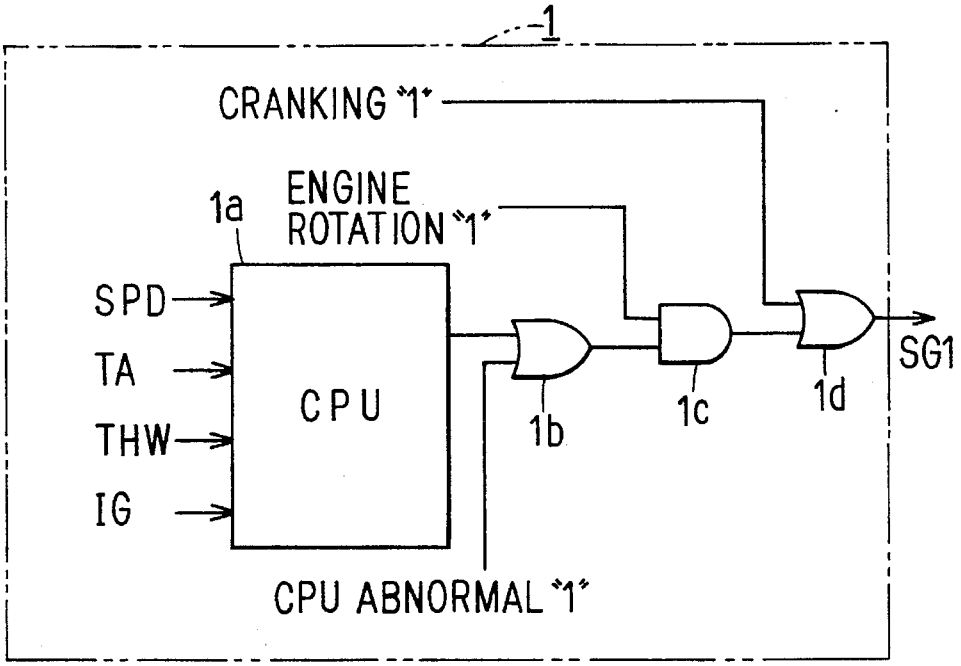
FIG. 3A
FIG. 3B
FIG. 3C
FIG. 3D
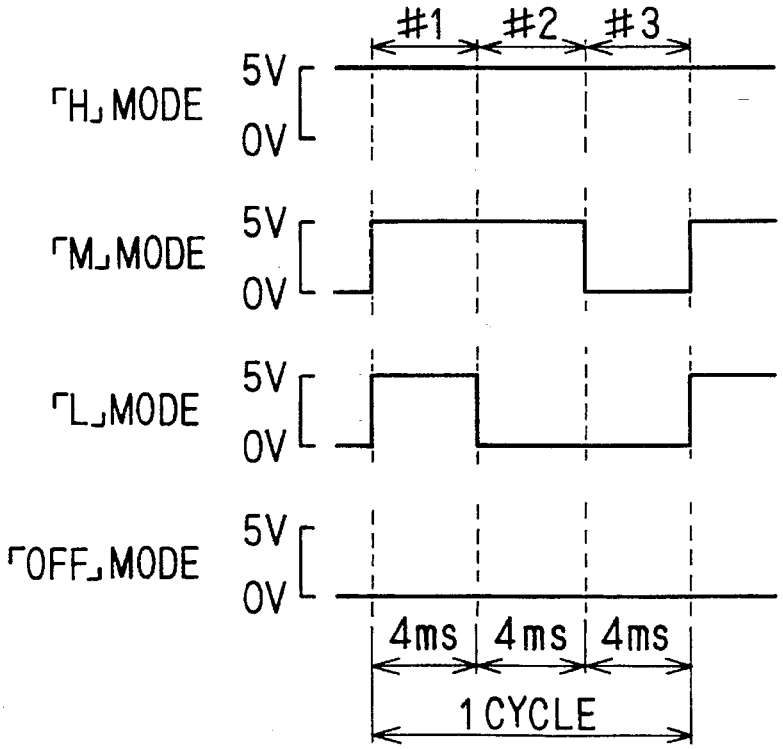

FIG. 5
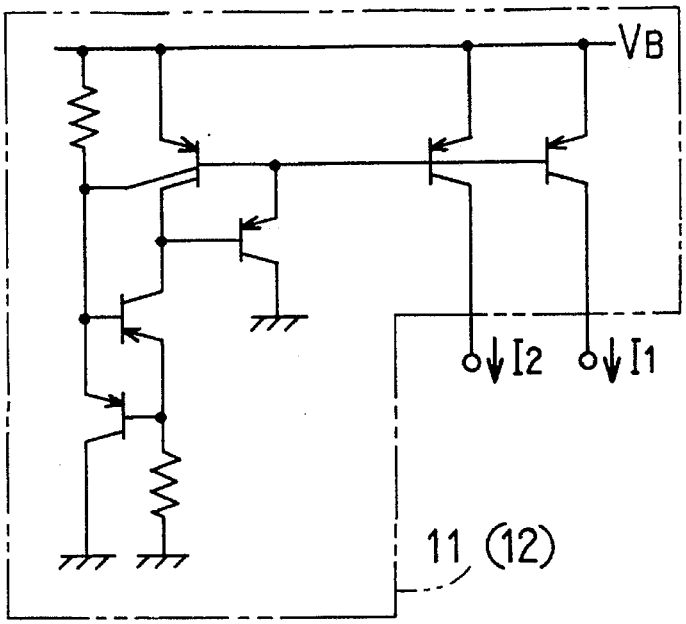
FIG. 6A1
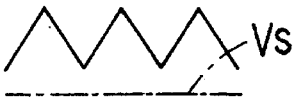
FIG. 6A2
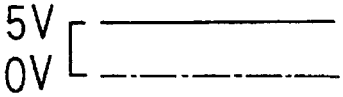
FIG. 6B1
FIG. 6B2
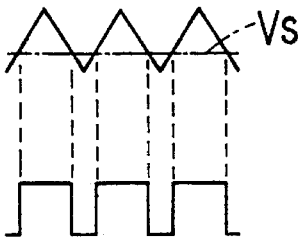
FIG. 6C1
FIG. 6C2
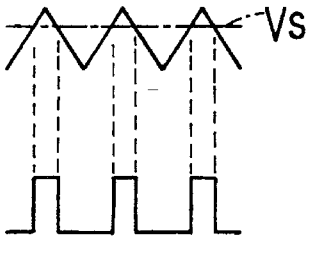

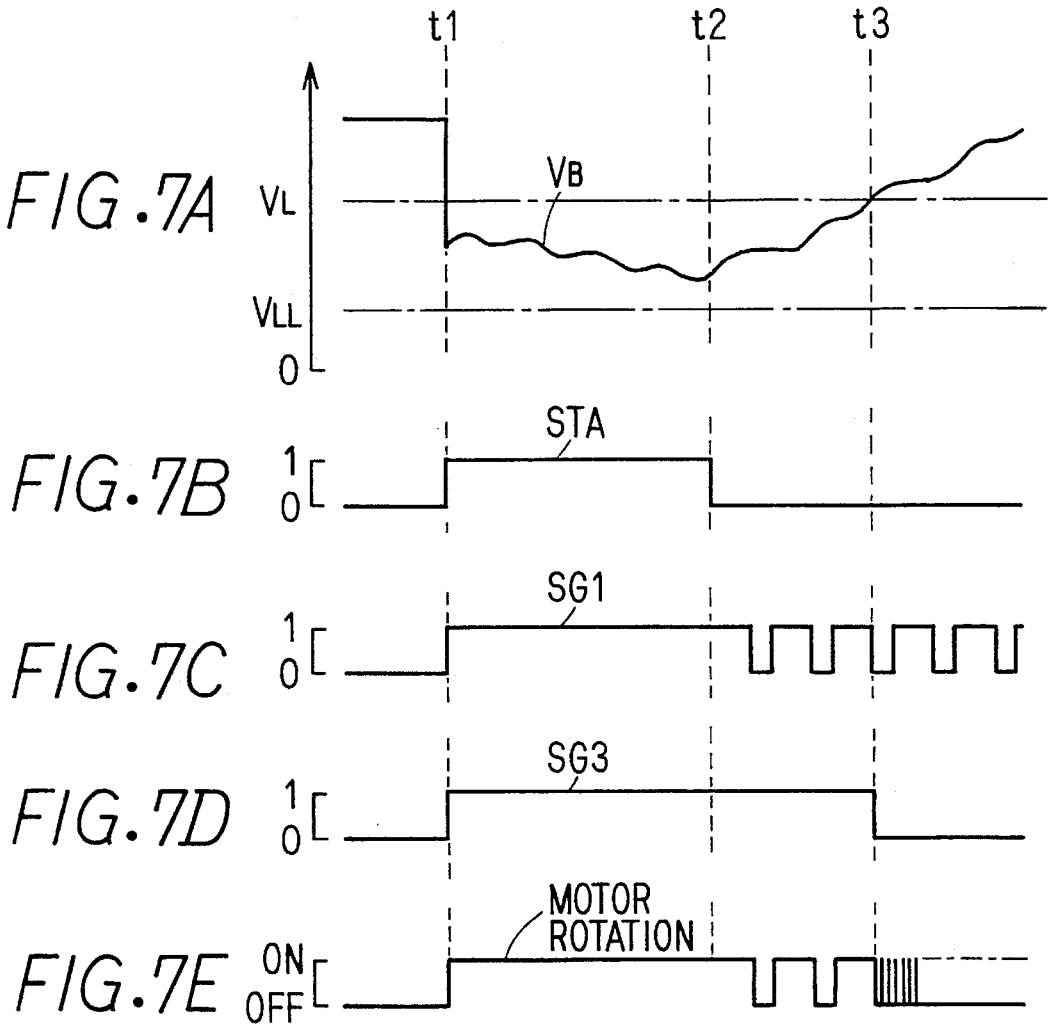
FIG.8
PRIOR ART
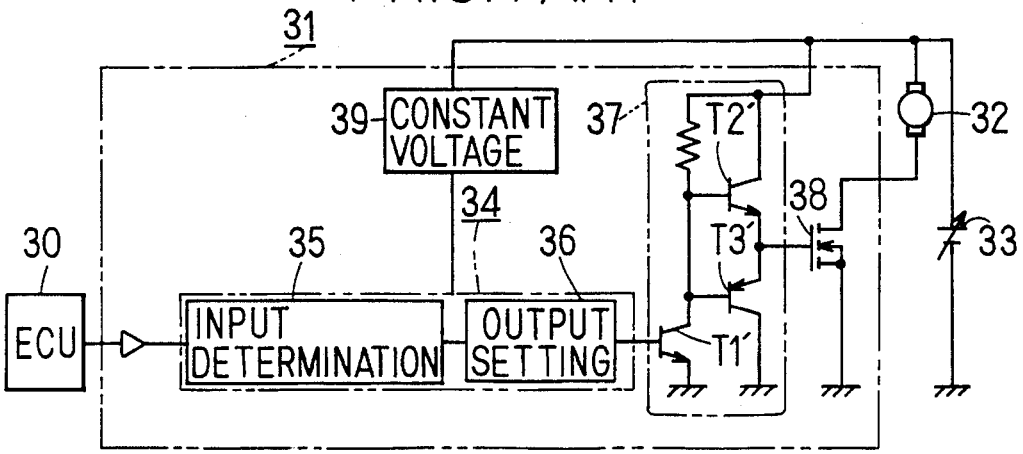

FUEL PUMP CONTROL DEVICE FOR INTERNAL COMBUSTION ENGINE

CROSS REFERENCE TO RELATED APPLICATION

This application is based upon and claims priority of Japanese Patent Application No. 6-112875 filed on May 26, 1994, the content of which is incorporated herein by reference.

BACKGROUND OF THE INVENTION

1. Field of the Invention

This invention relates to a control device for a fuel pump used for an internal combustion engine mounted on vehicles.

2. Description of Related Art

In the conventional fuel control device shown in FIG. 8, an engine control computer unit (ECU) 30 outputs a pump control signal indicating the engine drive state (vehicle speed, throttle opening angle, engine rpm, etc.) to a pump control circuit 31, and the pump control circuit 31 controls a fuel pump drive motor (pump drive motor) 32 according to the input signals. In other words, with the pump control circuit 31 the pump control signal is input to an internal logic section (signal processing circuit) 34 so that processing of the designated signal by means of an input determination circuit 35 and an output setting circuit 36 of the logic section 34 is carried out, after which the signal is sent to a drive circuit 37 to drive a FET (power MOS-FET) 38. Then, in accordance with operation of transistors T1'–T3' of the drive circuit 37, the FET 38 carries out ON/OFF drive to control current from a battery 33 to the pump drive motor 32. A constant voltage circuit 39 generates a constant voltage from the battery 33 and supplies the constant voltage to the internal logic section 34.

Furthermore, the internal logic section 34 is required in order to convert the pump control signal to a signal conforming to the actual pump drive in order to realize high-accuracy fuel pump control of recent years. In other words, if the engine control computer 30 outputs a low frequency duty signal (pump control signal) which is computed for each designated interrupt routine, the internal logic section 34 converts the duty signal into a high frequency signal. In such a case, due to pump drive based on the high frequency signal, it is possible to carry out high speed switching of the motor 32 at a cycle that is faster than the time constant of the pump drive motor 32 (response in reply to speed commands), thus achieving smooth operation of the fuel pump.

However, with the conventional fuel pump control device described above, the following problems occur due to a decline in battery voltage. In other words, with a control device of this type, as described above, signal processing of the pump control signals by the internal logic section 34 is required. However, if the battery voltage declines to a value lower than the required minimum drive voltage of the internal logic section 34, it is no longer possible to insure stable operation of the internal logic section 34. As a result, if the battery voltage declines, a situation occurs in which the pump drive motor 32 stops suddenly against the will of the driver.

Particularly when starting the engine during the cold winter period or when the battery 33 is running down, it requires time until initial combustion in the engine so that the cranking period becomes longer and the battery voltage declines considerably. In such a case, the operation of the internal logic section 34 becomes unstable so that the pump drive motor 32 stops unexpectedly, thus causing impediments to starting the engine.

Furthermore, due to a variety of engine control methods and engine specifications, a further increase in the input modes of the internal logic section 34 and more complex internal circuits can be expected. For this reason, it becomes difficult to insure stable operation of the internal logic section 34 during the decline in battery voltage.

SUMMARY OF THE INVENTION

This invention has been made to solve the above problems and its purpose is to provide a control device for a fuel pump of an internal combustion engine which can control the fuel pump regardless of the processing operations of a signal processing circuit during a decline in battery voltage, thus allowing supply of at least the minimum fuel requirement.

According to the invention, an engine control computer generates and outputs pump control signals in response to engine running state. A signal processing circuit operates with battery voltage to carry out the designated signal processing in response to the pump control signals from the control computer. The threshold value of a low-voltage detection circuit is set according to the voltage level to insure minimum drive voltage of the signal processing circuit. When the battery voltage falls below the threshold value, the low-voltage detection circuit outputs a signal to indicate that state. A signal selection circuit inputs a pump control signal sent as a result of processing by the signal processing circuit and a pump control signal sent by bypassing the signal processing circuit. When there is signal output from the low-voltage detection circuit, the latter one of the above-mentioned two pump control signals is selected in order to operate a switching element drive circuit. The drive circuit drives a switching element with the signal selected by the signal selection circuit. Due to drive of the switching element, electric current from the battery to the drive motor of the fuel pump is controlled.

In other words, the signal processing circuit processes the pump control signal from the control computer to a signal that is suited to actual control of the fuel pump. If the battery voltage declines below the voltage level to insure minimum drive voltage of the signal processing circuit, its operation becomes unstable. However, with the present structure, if the battery voltage is above the predetermined voltage level, the fuel pump is controlled by a signal following processing by the signal processing circuit. If the battery voltage falls below the predetermined voltage level, the fuel pump is controlled by the signal that has bypassed the signal processing circuit. As a result, it is possible to obtain the minimum required fuel supply even when the battery voltage declines.

Preferably, the signal processing circuit operates according to the constant voltage supplied from the constant voltage circuit. If the battery voltage falls to the voltage level where it is not possible to assure the constant voltage, the low-voltage detection circuit outputs a signal indicating that state. In other words, in order to assure constant voltage, it is determined by the voltage level whether the battery voltage is at the voltage level to guarantee the minimum drive voltage of the signal processing circuit or not.

When an engine is cranked by a starter motor, a temporary large decline in battery voltage will occur. Preferably, with the switching element retained in an ON state, the battery voltage is applied directly to the drive motor of the fuel pump. In such a case, even if, for example, there is a decline in battery voltage because the cranking period becomes longer, there is still fuel supply by the fuel pump and engine starting is carried out.

Preferably, if the battery voltage declines to a voltage level where it is no longer possible to guarantee operation of the system for input of the pump control signal, the switching element is turned OFF. In such a case, the pump which has declined to a state where control is not possible definitely stops.

More preferably, if the battery voltage is at a voltage level between the threshold value of the low-voltage detection circuit and the above-mentioned drive stop voltage, a drive power source section supplies the drive power to the switching element. A drive stop section turns the switching element OFF at the same voltage level to stop drive of the fuel pump. Thus, even in cases where operation of the drive system driving the switching element would become unstable due to the decline in battery voltage, operation of the drive power source section and the drive stop section controls drive and stopping of the fuel pump.

BRIEF DESCRIPTION OF THE DRAWINGS

In the accompanying drawings:

FIG. 2 is a circuit diagram showing the internal structure of an engine control computer;

FIGS. 3A through 3D are waveform charts showing the 4-mode duty ratio signals generated by a CPU;

FIG. 5 is a circuitry diagram showing the structure of a constant current circuit;

FIGS. 6A1 through 6C2 are waveform charts showing input and output of a comparator of an output setting circuit of the internal logic section;

FIGS. 7A through 7E are waveform charts showing operation of a fuel pump control device in the embodiment; and FIG. 8 is a circuitry diagram showing the electrical structure of a conventional fuel pump control device.

DETAILED DESCRIPTION OF THE PREFERRED EMBODIMENTS

Figure 1:
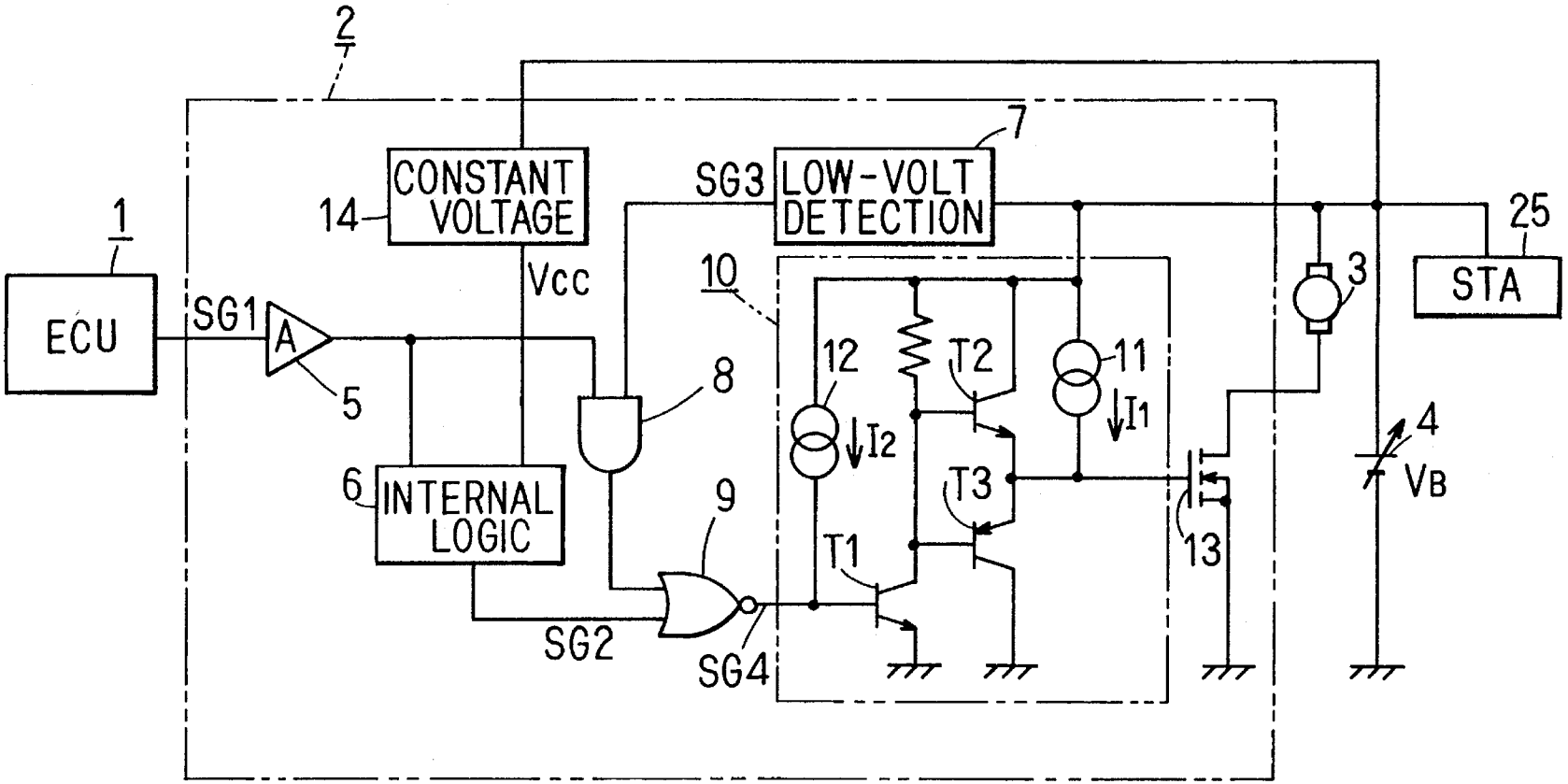
FIG. 1 is a circuit diagram showing an electrical circuit configuration of a fuel pump control device according to the embodiment of the invention.

As shown in FIG. 1, a fuel pump control device in this embodiment comprises an engine control computer unit (ECU) 1 to generate and output a pump control signal SG1, and a pump control circuit 2 to control a drive motor 3 of a fuel pump (hereinafter: pump drive motor) according to the pump control signal SG1 from computer 1. In the pump control circuit 2, an FET (N-channel power MOS-FET) 13 acting as a switching element is connected in series with the pump drive motor 3 and a battery 4 (rated voltage VB: 12 V). Electric current to the motor 3 undergoes intermittent control according to ON/OFF of the FET 13. The fuel pump is disposed in a fuel tank not shown in the figure. The fuel (gasoline) in the fuel tank is pumped up by means of driving the fuel pump and is supplied to an engine by a fuel injection system comprising, for example, a pressure regulator and injectors in the known manner. Furthermore, in this embodiment the pump drive motor 3 is connected to the side of the battery 4 relative to the FET 13. However, it is also possible to connect this to the ground side and thus create a so-called high-side switching circuit. Also connected to the battery 4 is a starter motor (STA) 25 in order to provide initial rotation of the engine not shown in the figure.

As shown in FIG. 2 illustrating the computer 1, there is input to a CPU 1*a* of the various detection signals indicative of the engine running state (vehicle speed signal SPD, throttle opening angle signal TA, water temperature signal THW, ignition switch signal IG, etc.). The CPU 1*a* computes the pump control amount for each designated interrupt based on the above-mentioned detection signals, and then generates the required duty ratio signal in accordance with the computation results. Further, the CPU 1*a* generates four modes of signals of differing duty ratio as shown in FIGS. 3A–3D: "H" mode signal, "M" mode signal, "L" mode signal, "OFF" mode signal. In a single cycle (12 ms) of the signal for each mode, the signal is divided into sections #1 to #3 at every 4 ms and set so that the signal level in each section is different. Furthermore, in the description of this embodiment, the logic high level (5 V potential) is denoted as "1" and the logic low level (0 V potential) is denoted as "0".

The duty ratio signals generated by the CPU 1*a* pass through OR circuit 1*b*, AND circuit 1*c* and OR circuit 1*d*, and are then output to the pump control circuit 2 as pump control signals SG1. In the case of an abnormality in the CPU 1*a*, "1" level is input to the OR circuit 1*b*. When the engine rotational velocity is 0 rpm or greater, "1" level is input to the AND circuit 1*c*. When the starter motor 25 is ON (during cranking), "1" level is input to the OR circuit 1*d*.

In the pump control circuit 2 shown in FIG. 1, the pump control signal SG1 from the above-mentioned engine control computer 1 passes through an amplifier 5 and is input to the internal logic section 6 acting as the signal processing circuit and to an AND circuit 8. The internal logic section 6 is driven according to the constant voltage Vcc (5 V) supplied by the constant voltage circuit 14. The constant voltage circuit 14 generates the constant voltage Vcc from the battery voltage VB. The internal logic section 6, in order to carry out high speed switching operation of the pump drive motor 3, converts the pump control signal SG1 in low frequency duty to a high frequency duty signal and outputs the converted signal SG2 to an NOR circuit 9.

A low-voltage detection circuit 7 is connected to the battery 4 and detects when the battery voltage VB declines below a predetermined voltage level. In other words, the low-voltage detection circuit 7 compares the battery voltage VB and a threshold value VL so that, when the battery voltage VB declines (so that VB<VL), it outputs a low voltage detection signal SG3 ("1") indicating that state to the AND circuit 8. As a result, if output from the low-voltage detection circuit 7 is "0" (VB>VL), the output from the AND circuit 8 is maintained at "0". If the output from the low-voltage detection circuit 7 is "1" (VB<VL), the output from the AND circuit 8 becomes the same signal as the pump control signal SG1. Furthermore, the threshold value VL of the low-voltage detection circuit 7 is set to a voltage that is slightly higher than the constant voltage Vcc (5 V) generated by the constant voltage circuit 14 (in the present embodiment VL=6 V). Also, if VB≧VL, the constant voltage Vcc is assured. The constant voltage Vcc is maintained at a normal voltage level (5 V) in order to keep normal operation of the internal logic section 6. In the present embodiment, the above-mentioned threshold value VL corresponds to the minimum drive voltage of the internal logic section 6.

The output from the internal logic section 6 and the output from the AND circuit 8 are input to the NOR circuit 9. If either of the input signals is "1", the NOR circuit 9 causes the output signal SG4 to become "0". If both input signals are "0", it causes the output signal SG4 to become "1". In the present embodiment, a signal selection circuit is composed of the AND circuit 8 and the NOR circuit 9.

As a result, if the battery voltage VB is higher than the threshold value VL (VB≧VL), the output from the AND circuit 8 is maintained at "0". The NOR circuit 9 outputs an inversion signal SG4 of the converted signal SG2 from the internal logic section 6. If the battery voltage VB declines below the threshold value VL (VB<VL), the AND circuit 8 outputs the pump control signal SG1 as it is and the NOR circuit 9 outputs the inversion signal of the pump control signal SG1. In other words, with the decline in the battery voltage VB, the NOR circuit 9 outputs the conversion signal SG2 from the internal logic section 6 and the pump control signal SG1 that bypasses the internal logic section 6, giving priority to the latter. Also, the system is constructed in such a way that the low-voltage detection circuit 7, the AND circuit 8 and the NOR circuit 9 operate normally to produce the output signal SG4 even if VB<VL.

There is input of the output signal SG4 from the NOR circuit 9 to the drive circuit (element drive circuit) driving the FET 13. The drive circuit 10 turns the FET 13 ON and OFF according to the output signal SG4. More specifically, in the drive circuit 10, the bases of transistors T2 and T3 acting as complementary emitter follower circuits are connected to the collector of the transistor T1 which undergoes emitter grounding. In other words, when the transistor T1 is ON, the transistor T3 goes ON so that the gate of FET 13 is pulled in the ground potential side and FET 13 turns OFF. At this time, supply of power from the battery 4 to the pump drive motor 3 is cut off. Conversely, if transistor T1 is OFF, the transistor T2 goes ON so that voltage is supplied to the gate of FET 13 and FET 13 turns ON. At this time, there is supply of electric power from the battery 4 to the pump drive motor 3.

Also, in the above-mentioned drive circuit 10, due to supply of battery voltage VB between the collector and emitter of the transistor T2, there is connection of a constant current circuit 11 generating a constant current I1. Due to supply of the same battery voltage VB to the base of the transistor T1, there is connection of a constant current circuit 12 generating a constant current I2. The constant currents I1 and I2 are both supplied to the drive circuit 10 by means of the same constant current source and are the same value (I1=I2). For example, the constant current circuits 11 and 12 are composed as shown in FIG. 5 so that, when VB≧2 V, the supply of the constant currents I1 and I2 are supplied, and when VB<2V, supply of the constant currents I1 and I2 is stopped. It is also possible to provide a system where the constant current circuits 11 and 12 are composed of different constant current sources or a system where I1 does not equal I2. However, by providing the systems described above (FIG. 5), there is the advantage that is easier to match characteristics. In the present embodiment, the drive power source section is composed of the constant current circuit 11, and the drive stop section is composed of constant current circuit 12.

Along with the decline in the battery voltage VB, the constant current circuits 11 and 12 operate as follows. When the base drive current of the transistor T2 declines as a result of a decline in the battery voltage VB, the collector saturation voltage of the transistor T2 becomes larger. At this time, due to the decline in the maximum voltage between the collector and emitter of the transistor T2, the gate voltage of the FET 13 becomes lower than the FET drive minimum voltage (1.5 V–2.0 V) so that the FET 13 goes OFF and there is a danger of the pump drive motor 3 stopping unexpectedly. However, with the present structure, by supplying the constant current I1 to the gate of the FET 13, it is possible to turn ON the FET 13 even with the above-mentioned voltage decline and thus continue operation of the pump drive motor 3.

When the battery voltage VB declines to a voltage level (drive stop voltage) where it is no longer possible to guarantee operation of the input system in the stage prior to the transistor T1, the transistor T1 is maintained in an ON state due to the constant current I2. In such a case, the transistor T3 goes ON so that the constant current I1 is pulled to the ground side and the FET 13 turns OFF. In other words, the pump drive motor 3 maintains a stop state and the motor 3 is prevented from rotating on its own in a voltage range where control is difficult. If the battery voltage VB declines to a voltage VLL(=2 V in the embodiment) where operation of the constant current circuits 11 and 12 is stopped, supply of constant current I1 and I2 is stopped.

Furthermore, regarding the setting values of the constant current I1 and I2, it is preferable to set to values which are about 2 decimal places smaller than the current ability of the transistor T2 so that there is no high speed switching of the FET 13 when the battery voltage VB declines, and also that the constant current I1 via transistor T3 is pulled to the ground side when the FET 13 is OFF. (For example, about several 100 μA).

Figure 4:
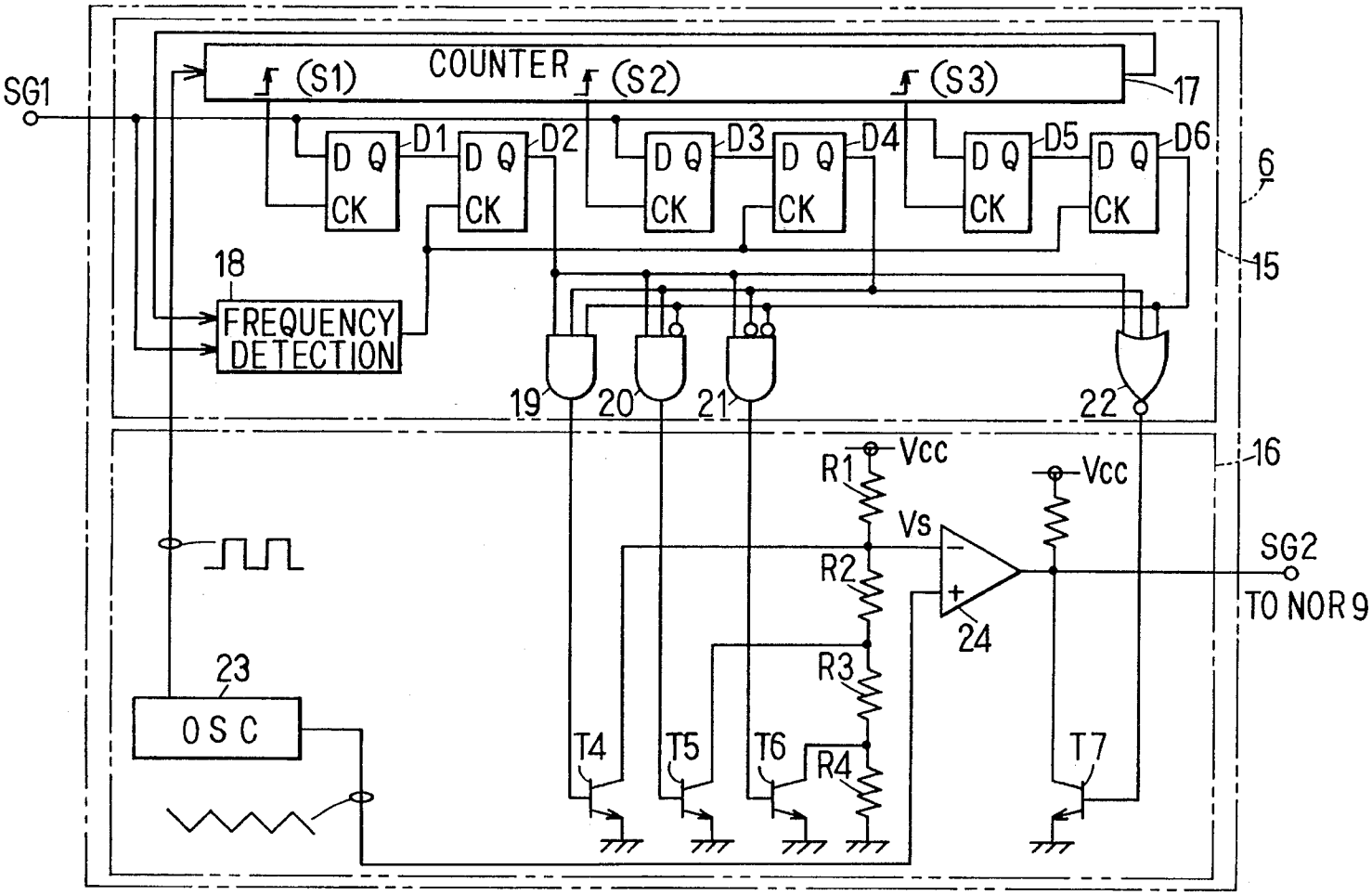
FIG. 4 is a circuitry diagram showing the structure of an internal logic section.

The internal logic section 6 includes as shown in FIG. 4, an input determination circuit 15 to determine the pump control signal SG1 from the engine control computer 1, and an output setting circuit 16 to convert the pump control signal SG1 based on the determination results of the input determination circuit 15 to a high frequency signal for output. The input determination circuit 15 comprises a counter 17, a frequency detection circuit 18, the flip-flop circuits D1–D6 and four logic circuits (AND circuits 19–21, NOR circuit 22). The frequency detection circuit 18 generates a 1-pulse signal for each cycle of the pump control signal SG1 (every 12 ms in the present embodiment) and the signal is output to the flip-flop circuits D2, D4 and D6 as clock signals.

The counter 17 computes the time based on the high frequency pulse signals from an oscillator circuit 23 (e.g., 20 kHz) and then detects the logic level from section #1 to section #3 of the pump control signal SG1. The clock signal is output to the flip-flop D1 during the detection time of the 1st section of the same signal, the clock signal is output to flip-flop D2 during the detection time of the 2nd section, and the clock signal is output to the flip-flop D5 during the detection time of the 3rd section. At this time, the flip-flop D1 reads the logic level of the 1st section of the pump control signal SG1, the flip-flop D3 reads the logic level of the second section, and the flip-flop D5 reads the logic level of the 3rd section. The flip-flops D2, D4 and D6 operate according to clock signals from the frequency detection circuit 18. At this timing, flip-flop D2 outputs the output signal of flip-flop D1, flip-flop D4 outputs the output signal of flip-flop D3, and flip-flop D6 outputs the output signal of flip-flop D5.

Based on the output signals from flip-flops D2, D4 and D6, one of the outputs from the AND circuits 19–21 and the NOR circuit 22 becomes "1" and is output to the output setting circuit 16 as the determination results of the pump control signal SG1. If the pump control signal SG1 at this time is an "H" (high rotation speed) mode signal, the output of the AND circuit 19 becomes "1"; if the pump control signal SG1 is an "M" (medium rotation speed) mode signal, the output of the AND circuit 20 becomes "1"; if the pump control signal SG1 is an "L" (low rotation speed) mode signal, the output of the AND circuit 21 becomes "1"; if the pump control signal SG1 is an "OFF" (rotation stop) mode signal, the output of the NOR circuit 22 becomes "1".

In the output setting circuit 16, the oscillator circuit 23 is connected to the positive input terminal of a comparator 24. Connected to a negative input terminal is a potential division point of the constant voltage Vcc according to resistances R1–R4. The comparator 24 outputs the results of comparing the high-frequency (20 kHz) triangular wave signals from the oscillator circuit 23 and the standard voltage Vs set by the constant voltage Vcc and the resistances R1–R4. Located on the output Side of the comparator 24 is a transistor T7 which fixes the conversion signal SG2 from the internal logical section 6 to "0" level if the output of the NOR circuit 22 is "1".

The standard voltage Vs of the comparator 24 is set to one of the three different voltage level values depending on the ON/OFF operation of the transistors T4–T6 according to the outputs of the above-mentioned AND circuits 19–21. When the output of the AND circuit 19 is "1", the standard voltage Vs is set to the lowest voltage level among the three (as shown in FIG. 6A1). If the output of the AND circuit 20 is "1", the standard voltage Vs is set to the middle voltage level (as shown in FIG. 6B1). If the output of the AND circuit 21 is "1", the standard voltage Vs is set to the highest voltage level (as shown in FIG. 6C1). As shown in FIGS. 6A2, 6B2 and 6C2, the comparator 24 outputs a pulse waveform duty signal (conversion signal SG2) based on the standard voltage Vs.

Next, operation of the fuel pump control device at the time of engine starting is described. In the time chart in FIG. 7A, during the engine cranking time denoted as times t1–t2, the battery voltage VB declines lower than the threshold value VL (6 V) due to the drive of the starter motor 25. At time t3 the battery voltage VB returns to a value above the threshold value VL.

At time t1 there is starting of cranking by the starter motor 25. At this time, the starter signal (FIG. 7B) is "1" so that the signal output from the OR circuit **1*d* shown in FIG. 2 is maintained at "1" and the pump control signal SG1 (FIG. 7C) becomes a signal where the duty ratio is 100%. At time t1, since the starter motor 25 provides initial rotation to move from an engine stop state, a large load is placed on the motor 25 so that a large current flows and the battery voltage VB declines greatly. If the battery voltage VB declines below the threshold value VL, the low-voltage detection signal SG3 (FIG. 7D) from the low-voltage detection circuit 7** becomes "1".

Because SG3="1" is input to the AND circuit 8 at this time, the pump control signal SG1 bypasses the internal logic section 6. That is, it passes through the AND circuit 8 and is input to the NOR circuit 9, so that SG1="1" is received and the output of the NOR circuit 9 is constantly "0" level. As a result, during the period t1–t2 the FET 13 is constantly ON and the pump drive motor 3 is maintained in an electric current state. In other words, although the battery voltage VB has declined to a voltage level where it is no longer possible to guarantee operation of the internal logic section 6, the pump drive motor 3 drives continually so that fuel supply from the fuel tank to the fuel injection system is carried out.

Following this, at time t2, after the initial combustion of air-fuel mixture occurs in the engine, the starter signal STA goes to "0". Thus, the pump control signal SG1 is converged to the required duty ratio signal corresponding to the engine running conditions. At this time, because VB<VL as was the case during the times t1–t2 described above, the pump control signal SG1 bypasses the internal logic section 6 and is input to the drive circuit 10, so that the FET 13 goes ON and OFF according to the input signals. In this case, the pump drive motor 3 undergoes low-speed switching in the low frequency duty signal (pump control signal SG1) so that drive and stop are repeated and the fuel supplied to the fuel injection system during engine starting is retained.

When the engine starts successfully after time t2, the battery 4 is charged subsequently by generation of an alternator so that the battery voltage VB gradually rises. At time t3 where VB≧VL, the low-voltage detection signal SG3 from the low-voltage detection circuit 7 returns to "0" level and the output from the AND circuit 8 becomes "0" level. In this case, the conversion signal SG2 in high frequency from the internal logic section 6 is output from the NOR circuit 9 so that the FET 13 undergoes high speed switching drive. In other words, after time t3 the pump drive motor 3 carries out the normal high speed switching drive.

During engine starting time when starting in winter or when the battery voltage VB is relatively low, the cranking period of the starter motor 25 (period shown by times t1–t2 in FIGS. 7A through 7E) becomes longer so that the battery voltage VB declines even further. In such a case, if the gate voltage of the FET 13 declines below the FET drive minimum voltage due to a decline in voltage between the collector and emitter of transistor T2, the constant current I1 is supplied to the gate of FET 13 so that FET 13 is turned ON. In other words, in this case as well the pump drive motor 3 is continuously driven. If the battery voltage VB declines to a state lower than that shown in FIG. 7A so that VB<VLL (2 V), supply of the constant current I1, I2 is stopped, the FET 13 goes OFF and the pump drive motor 3 goes to a stop state regardless of the input signal.

According to the fuel pump control device as described above in detail with reference to the presently preferred embodiment, the following advantages can be obtained.

If the battery voltage VB is at a voltage level where the constant voltage Vcc can be maintained, the pump drive motor 3 is controlled by the signal following processing by the internal logic section 6. If the battery voltage VB lowers to the voltage level where the constant voltage Vcc cannot be guaranteed, the pump drive motor 3 is controlled by the signal that has bypassed the internal logic section 6. As a result, even when the battery voltage VB declines, it is possible to drive the pump drive motor 3 and secure the minimum required fuel supply. Particularly during cranking the battery voltage VB declines considerably due to drive of the starter motor 25. However, it is possible to continue fuel supply with drive of the pump drive motor 3 and thus promote engine starting. Furthermore, because the structure is such that the FET 13 is maintained in an ON state during cranking, even if the cranking period becomes longer, it is possible to supply sufficient fuel to the fuel injection system (injector, etc.).

With this embodiment, by including the constant current circuit 11 in the drive circuit 10, electric power is supplied to the gate of FET 13 regardless of a the voltage decline in the transistor T2 (drive circuit 10) during the decline in the battery voltage VB (VLL<VB<VL). This in turn makes it possible to secure the fuel supply with the pump drive motor 3. Furthermore, by including the constant current circuit 12 in the drive circuit 10, even if the battery voltage VB declines to a voltage level where it is impossible to insure operation of the signal input system, it is possible to maintain the FET 13 in an OFF state. As a result, it is possible to cut current to the pump drive motor 3 at the same voltage level and thus definitely stop the pump drive motor 3 that has fallen into a state where control is not possible.

Also, even if the internal logic section 34 should become complex due to a variety of needs regarding engine control methods and engine specifications, it is possible to appropriately carry out fuel pump control.

It is also possible to realize the following modifications as other embodiments of this invention:

(1) In the above embodiment, during normal times (VB≧VL) there is operation of the last stage circuits (drive circuit 10, etc.) with the conversion signal SG2 from the internal logic section 6. When the voltage declines (VB<VL), there is priority operation of the last stage circuits by making use of the latter of the following two signals: (a) the above-mentioned conversion signal SG2 and (b) the pump control signal SG1 which bypasses the internal logic section 6. As an alternative, during normal times (VB≧VL) it is possible to operate with priority the last stage circuits by making use of the latter of the two signals: pump control signal SG1 and conversion signal SG2. During low voltage (VB<VL), it is possible to cut off the conversion signal SG2 and use the pump control signal SG1 to operate the last stage circuits. In such a case, instead of the AND circuit 8 in FIG. 1, it is possible, for example, to include a switch either just in front of or just behind the internal logic section 6 which turns ON and OFF according to the low-voltage detection signal SG3 from the low-voltage detection circuit 7, and thus open the switch during low voltage (VB<VL).

(2) In the above embodiment, in the internal logic section 6 the pump control signal SG1 in low frequency duty is converted into the high-frequency signal and the conversion signal SG2 is used to control current flow to the pump drive motor 3. As an alternative, it is possible in the internal logic section 6 to amplify the pump control signal SG1 to a voltage level corresponding to its duty ratio and to control current flow to the pump drive motor 3 according to the difference in the voltage level.

(3) In the above embodiment the switching element composed of the N-channel MOS-FET 3 is driven by the drive circuit 10 composed of the transistors T1–T3. However, it is also possible to convert the switching element into a bipolar transistor or IGBT, etc. and thus modify the structure of the drive circuit 10 to another structure in which it is possible to drive the above-mentioned switching element.

(4) In the above embodiment if the battery voltage VB decreases (VLL<VB<VL), the transistor T1 of the drive circuit 10 is operated according to the pump control signal SG1. Instead, it is possible with a decline in the battery voltage VB to connect the base of the transistor T1 to the ground and maintain transistor T1 in the OFF state. In such a case, if the pump control signal SG1 is produced, the pump drive motor 3 operates with the battery directly connected.

(5) In the above embodiment by supplying the constant current I1 from the constant current circuit 11 to the gate of the FET 13, even if the voltage decline of the transistor T2 becomes quite large, drive of FET 13 is continued. However, a structure is also possible where, instead of the constant current circuit 11, the gate of FET 13 is pulled up by resistance. In such a case, the resistance corresponds to the drive power source section.

(6) In the above embodiment the pump control signal SG1 generated by the engine control computer 1 becomes the 4-mode duty ratio signal. It is also possible to change to a 3-mode signal or to change to a signal with another configuration.

What is claimed is:

1. A fuel control device for an internal combustion engine, said device comprising:

a switching element, connected in series with a battery and a drive motor for a fuel pump, for controlling an electric current from said battery to said motor;

a drive circuit, connected to a drive terminal of said switching element, for driving said switching element;

a control computer generating a first pump control signal in accordance with engine operating conditions;

a signal processing circuit, separate from said control computer and operated with a battery voltage of said battery, for producing a second pump control signal through a predetermined signal processing on said first pump control signal;

a low-voltage detection circuit, connected to said battery and separate from said control computer, for comparing said battery voltage with a threshold value indicative of a voltage level which assures a minimum drive voltage for an operation of said signal processing circuit, said detection circuit generating a detection signal indicative of a voltage condition of said battery voltage lower than said threshold value; and a signal selection circuit, connected to said control computer, said signal processing circuit and said drive circuit and responsive to said detection signal, for selecting said first pump control signal and applying said first pump control signal to said drive circuit to drive said drive motor when said detection signal is produced and selecting said second pump control signal for said drive circuit when said detection signal is absent, said first pump control signal being determined to be more effective to drive said drive motor when said battery voltage is lower than said threshold value.

2. A fuel pump control device according to claim 1, further comprising:

a constant voltage circuit, connected between said battery and said signal processing circuit, for supplying a constant voltage from said battery voltage to said signal processing circuit, said threshold value of said low-voltage detection circuit being determined to assure supply of said constant voltage to said signal processing circuit.

3. A fuel control device for an internal combustion engine, said device comprising:

a switching element, connected in series with a battery and a drive motor for a fuel pump, for controlling an electric current from said battery to said motor;

a drive circuit, connected to a drive terminal of said switching element, for driving said switching element;

a control computer generating a first pump control signal in accordance with engine operating conditions;

a signal processing circuit, operated with a battery voltage of said battery, for producing a second pump control signal through a predetermined signal processing on said first pump control signal;

a low-voltage detection circuit, connected to said battery, for comparing said battery voltage with a threshold value indicative of a voltage level which assures a minimum drive voltage for an operation of said signal processing circuit, said detection circuit generating a detection signal indicative of a low voltage condition of said battery voltage; and a signal selection circuit, connected to said control computer, said signal processing circuit and said drive circuit and responsive to said detection signal, for selecting at least said first pump control signal and applying a selected signal to said drive circuit to drive said drive motor when said detection signal is produced, said first pump control signal being determined to be more effective to drive said drive motor when said battery voltage is low, wherein said control computer produces said first pump control signal in a form of a duty pulse signal and a continuous signal when said engine is in cranking and after-cranking conditions, respectively, so that said switching element is turned on more continuously at the time of said cranking condition.

4. A fuel pump control device according to claim 1, wherein said drive circuit further includes:

a drive power circuit means for supplying an electric current to said switching element when said battery voltage is between said threshold value of said low-voltage detection threshold circuit and a further threshold value lower than said threshold value.

5. A fuel pump control device according to claim 4, wherein said drive circuit includes:

a stop circuit means for turning off said switching element, irrespective of said first pump control signal and said second pump control signal, when said battery voltage falls below said further threshold value.

6. A fuel pump control device for an internal combustion engine fuel supply system having a battery and a fuel pump, said device comprising:

first duty signal generating means for generating a first duty pulse signal at a predetermined frequency;

second duty signal generating means provided separately from said first duty signal generating means for generating a second duty pulse signal at a predetermined second frequency higher than said first frequency by converting said first duty pulse signal;

voltage detection means for detecting a low voltage condition of said battery and generating a detection signal indicative thereof, said low voltage condition disabling operation of said second duty signal generating means;

signal selection means for selecting said second duty pulse signal normally and said first duty pulse signal in response to said detection signal; and drive circuit means for driving said fuel pump by said battery in response to a selected one of said first duty pulse signal and said second duty pulse signal.

7. A fuel pump control device according to claim 6, further comprising:

drive stop means for stopping operation of said drive circuit means, irrespective of said selected signal from said selection means, when a voltage of said battery falls further below said low voltage condition.

8. A fuel pump control device according to claim 1, wherein said signal processing circuit includes an internal logic means for converting said first pump control signal to a signal conforming to actual fuel pump drive.

9. A fuel control device for an internal combustion engine, said device comprising:

a switching element, connected in series with a battery and a drive motor for a fuel pump, for controlling an electric current from said battery to said motor;

a drive circuit, connected to a drive terminal of said switching element, for driving said switching element;

a control computer generating a first pump control signal in accordance with engine operating conditions;

a signal processing circuit, operated with a battery voltage of said battery, for producing a second pump control signal through a predetermined signal processing on said first pump control signal;

a low-voltage detection circuit, connected to said battery, for comparing said battery voltage with a threshold value indicative of a voltage level which assures a minimum drive voltage for an operation of said signal processing circuit, said detection circuit generating a detection signal indicative of a low voltage condition of said battery voltage; and a signal selection circuit, connected to said control computer, said signal processing circuit and said drive circuit and responsive to said detection signal, for selecting at least said first pump control signal and applying a selected signal to said drive circuit to drive said drive motor when said detection signal is produced, said first pump control signal being determined to be more effective to drive said drive motor when said battery voltage is low, said drive circuit further including:

a drive power circuit means for supplying an electric current to said switching element when said battery voltage is between said threshold value of said low-voltage detection threshold circuit and a further threshold value lower than said threshold value of said low voltage detection circuit, said drive power circuit means supplying a constant current to said switching element so as to ensure continued operation of said drive motor even when said battery voltage is low.

10. A fuel control device for an internal combustion engine, said device comprising:

a switching element, connected in series with a battery and a drive motor for a fuel pump, for controlling an electric current from said battery to said motor;

a drive circuit, connected to a drive terminal of said switching element, for driving said switching element;

a control computer generating a first pump control signal in accordance with engine operating conditions;

a signal processing circuit, operated with a battery voltage of said battery, for producing a second pump control signal through a predetermined signal processing on said first pump control signal;

a low-voltage detection circuit, connected to said battery, for comparing said battery voltage with a threshold value indicative of a voltage level which assures a minimum drive voltage for an operation of said signal processing circuit, said detection circuit generating a detection signal indicative of a low voltage condition of said battery voltage; and a signal selection circuit, connected to said control computer, said signal processing circuit and said drive circuit and responsive to said detection signal, for selecting at least said first pump control signal and applying a selected signal to said drive circuit to drive said drive motor when said detection signal is produced, said first pump control signal being determined to be more effective to drive said drive motor when said battery voltage is low, said drive circuit including:

a stop circuit means for turning off said switching element, irrespective of said first pump control signal and said second pump control signal, said stop circuit means including transistor means for controlling current to said switching element so as to turn-off said switching element and thus prevent operation of said drive motor, when said battery voltage falls below a further threshold voltage value which is a value set lower than a value at which operation of the drive motor will stop.

11. A fuel control device for an internal combustion engine, said device comprising:

a switching element, connected in series with a battery and a drive motor for a fuel pump, for controlling an electric current from said battery to said motor;

a drive circuit, connected to a drive terminal of said switching element, for driving said switching element;

a control computer generating a first pump control signal in accordance with engine operating conditions;

a signal processing circuit, operated with a battery voltage of said battery, for producing a second pump control signal through a predetermined signal processing on said first pump control signal;

a low-voltage detection circuit, connected to said battery, for comparing said battery voltage with a threshold value indicative of a voltage level which assures a minimum drive voltage for an operation of said signal processing circuit, said detection circuit generating a detection signal indicative of a low voltage condition of said battery voltage; and a signal selection circuit, connected to said control computer, said signal processing circuit and said drive circuit and responsive to said detection signal, for selecting at least said first pump control signal and applying a selected signal to said drive circuit to drive said drive motor when said detection signal is produced, said first pump control signal being determined to be more effective to drive said drive motor when said battery voltage is low, said drive circuit including:

a stop circuit means for turning off said switching element, irrespective of said first pump control signal and said second pump control signal, said stop circuit means including means for stopping a supply of current to said switching element when said battery voltage falls below a further threshold voltage value which is a value set lower than a value at which operation of the drive motor will stop.

12. A control device for controlling a motor for use in a vehicle, said device comprising:

a switching element, connected in series with a battery and the motor, for controlling an electric current from said battery to said motor;

a drive circuit, connected to a drive terminal of said switching element, for driving said switching element;

a control computer generating a first control signal in accordance with the vehicle engine operating conditions;

a signal processing circuit, separate from said control computer and operated with a battery voltage of said battery, for producing a second control signal through a predetermined signal processing on said first control signal;

a low-voltage detection circuit, connected to said battery and separate from said control computer, for comparing said battery voltage with a threshold value indicative of a voltage level which assures a minimum drive voltage for an operation of said signal processing circuit, said detection circuit generating a detection signal indicative of a voltage condition of said battery voltage lower than said threshold value; and a signal selection circuit, connected to said control computer, said signal processing circuit and said drive circuit and responsive to said detection signal, for selecting said first control signal and applying said first control signal to said drive circuit to drive said motor when said detection signal is produced and selecting said second control signal for said drive circuit when said detection signal is absent, said first control signal being determined to be more effective to drive said motor when said battery voltage is lower than said threshold value.

* * * * *